US008950293B2

(12) United States Patent
Hu

(10) Patent No.: US 8,950,293 B2
(45) Date of Patent: Feb. 10, 2015

(54) RATCHET WRENCH

(71) Applicant: Bobby Hu, Taichung (TW)

(72) Inventor: Bobby Hu, Taichung (TW)

( * ) Notice: Subject to any disclaimer, the term of this patent is extended or adjusted under 35 U.S.C. 154(b) by 219 days.

(21) Appl. No.: 13/737,086

(22) Filed: Jan. 9, 2013

(65) Prior Publication Data

US 2014/0096652 A1 Apr. 10, 2014

(30) Foreign Application Priority Data

Oct. 5, 2012 (TW) ..... 101136952 A

(51) Int. Cl.
*B25B 13/46* (2006.01)

(52) U.S. Cl.
CPC ..... *B25B 13/462* (2013.01)
USPC ..... 81/58.2

(58) Field of Classification Search
CPC ..... B25B 13/46; B25B 13/462
USPC ..... 81/58.2, 60, 61
See application file for complete search history.

(56) References Cited

U.S. PATENT DOCUMENTS

| | | | | | |
|---|---|---|---|---|---|
| 2,527,033 | A | * | 10/1950 | Rodgers et al. | 81/58.2 |
| 3,921,474 | A | * | 11/1975 | Dyck et al. | 81/91.2 |
| 4,631,990 | A | | 12/1986 | Hughes | |
| 4,718,315 | A | * | 1/1988 | Nitschmann | 81/58.2 |
| 5,467,672 | A | * | 11/1995 | Ashby | 81/58.2 |
| 5,501,124 | A | * | 3/1996 | Ashby | 81/58.2 |
| 6,155,140 | A | * | 12/2000 | Tsai | 81/61 |
| 6,227,076 | B1 | * | 5/2001 | Murray | 81/58.2 |
| 8,100,036 | B2 | * | 1/2012 | Huang | 81/58.2 |

* cited by examiner

*Primary Examiner* — David B Thomas
(74) *Attorney, Agent, or Firm* — Alan D. Kamrath; Kamrath IP Lawfirm, P.A.

(57) ABSTRACT

An open-ended ratchet wrench includes a body having a fixed jaw, a first pivotal portion, and a second pivotal portion. A driving member is rotatably mounted to the fixed jaw. The driving member includes an inner periphery for holding an object to be driven. A first movable jaw includes a first pivotal end pivotably connected to the first pivotal portion and a first movable end having a first toothed portion meshed with a toothed portion on an outer periphery of the driving member. A second movable jaw includes a second pivotal end pivotably connected to the second pivotal portion and a second movable end having a second toothed portion meshed with the toothed portion of the driving member.

15 Claims, 11 Drawing Sheets

RATCHET WRENCH

BACKGROUND OF THE INVENTION

The present invention relates to a ratchet wrench and, more particularly, to an open-ended ratchet wrench that can be cleaned with water.

U.S. Pat. No. 4,631,990 discloses an open-ended ratchet wrench including a fixed jaw and a pivoting jaw. A box-end insert, a socket drive insert, and an open-end insert are selectively received between the fixed jaw and the pivoting jaw. A bottom pawl and a side pawl are respectively mounted in two pawl seats in the fixed jaw. The bottom pawl and the side pawl drive the insert for driving an object, such as a nut or bolt head or the like. The insert provides a ratcheting function without repeatedly engaging the ratchet wrench with the object.

However, dust and dirt enter the ratchet wrench and get stuck between the insert and the pawls during use, adversely affecting the pawls and the insert. Thus, undesired sliding movement occurs between the pawls and the insert, reducing the torque provided by the ratchet wrench. Further, movement of the pawls in the pawl seats also carries dust and dirt into the pawl seats. Accumulation of the dust and dirt adversely affects operation of the pawls, causing malfunction of the ratchet wrench. Since accumulation of dust and dirt is an inevitable problem, the manufacturer of the ratchet wrench must take the responsibility when a user returns the ratchet wrench damaged without improper usage. Namely, the manufacturer repairs the ratchet wrench or gives the user a new one for free. This significantly increases the costs for the manufacturer in addition to leaving bad reputation and untrustworthiness to the user.

Furthermore, the pivoting jaw of the ratchet wrench is manually operated to allow the user to change the insert. The ratcheting function of the ratchet wrench is achieved by other components. Namely, the costs for manufacturing and assembly are increased by the complicated components of the ratchet wrench.

Further, the torque capacity of the ratchet wrench is insufficient such that the components inside the ratchet wrench are liable to damage if the user applies a large force. Further, the components inside the ratchet wrench are small and, thus, difficult to manufacture while having a high maintenance cost.

Thus, a need exists for a novel open-ended ratchet wrench avoiding accumulation of dust and dirt.

BRIEF SUMMARY OF THE INVENTION

The present invention solves this need and other problems in the field of durable open-ended ratchet wrenches by providing an open-ended ratchet wrench including a body. The body includes a handle portion and an operative end. The handle portion is adapted to be operated by a user to rotate the body about a rotating axis. The operative end includes a fixed jaw, a first pivotal portion, and a second pivotal portion. A driving member is mounted to the fixed jaw and rotatable relative to the fixed jaw about the rotating axis, with the driving member having a central axis coincident with the rotating axis. The driving member includes an inner periphery and an outer periphery spaced from the inner periphery in a radial direction perpendicular to the central axis. The inner periphery of the driving member is adapted to hold an object to be driven to rotate about the rotating axis. The outer periphery of the driving member includes a toothed portion. A first movable jaw includes a first pivotal end and a first movable end opposite to the first pivotal end. The first pivotal end is pivotably connected to the first pivotal portion of the operative end of the body. The first movable end includes a side facing the driving member and having a first toothed portion. The first toothed portion meshes with the toothed portion of the driving member. A second movable jaw includes a second pivotal end and a second movable end opposite to the second pivotal end. The second pivotal end is pivotably connected to the second pivotal portion of the operative end of the body. The second movable end includes a side facing the driving member and having a second toothed portion. The second toothed portion meshes with the toothed portion of the driving member.

Each of the first and second movable jaws is pivotable between a first position and a second position. The first toothed portion engages with the toothed portion of the driving member when the first movable jaw is in the first position. The first toothed portion disengages from the toothed portion of the driving member when the first movable jaw is in the second position. The second toothed portion engages with the toothed portion of the driving member when the second movable jaw is in the first position. The second toothed portion disengages from the toothed portion of the driving member when the second movable jaw is in the second position.

Preferably, the driving member further includes an opening extending from the inner periphery through the outer periphery, forming first and second end faces extending between the inner and outer peripheries. The opening has a first length between the first and second end faces in a circumferential direction about the rotating axis. Each of the first and second toothed portions includes a plurality of teeth, with the rearmost tooth of the first toothed portion located between the foremost tooth of the first toothed portion and the first pivotal end, with a rearmost tooth of the second toothed portion located between the a foremost tooth of the second toothed portion and the second pivotal end. A spacing between the foremost tooth of the first toothed portion and the rearmost tooth of the second toothed portion in the circumferential direction is larger than the first length.

Preferably, a second length between the foremost tooth and the rearmost tooth of the first toothed portion in the circumferential direction is smaller than the first length. A third length between the foremost tooth and the rearmost tooth of the second toothed portion in the circumferential direction is smaller than the first length.

Preferably, the toothed portion of the driving member has a first pitch, the first toothed portion has a second pitch equal to the first pitch, and the second toothed portion has a third pitch equal to the first pitch.

Preferably, the second pivotal portion is located between the fixed jaw and the first pivotal portion. The first movable jaw is pivotable relative to the body about a first pivot axis parallel to the rotating axis. The second movable jaw is pivotable relative to the body about a second pivotal axis parallel to the rotating axis. The third length is equal to the second length.

Preferably, two teeth of the toothed portion of the driving member mesh with the foremost tooth of the second toothed portion and a tooth of the second toothed portion immediately behind the foremost tooth of the second toothed portion. The two teeth of the toothed portion of the driving member also mesh with the rearmost tooth of the first toothed portion and a tooth of the first toothed portion immediately in front of the rearmost tooth of the first toothed portion.

Preferably, the open-ended ratchet wrench further includes another second movable jaw identical to the second movable jaw, with the first movable jaw located between the second movable jaws. A spacing between the first toothed portion and the fixed jaw is smaller than a spacing between the fixed jaw and each second movable jaw.

Preferably, the spacing between the first toothed portion and the fixed jaw is smaller than an outer diameter of the toothed portion of the driving member. The driving member further includes two limiting rings spaced from each other along the central axis, with the first movable end of the first movable jaw and the second movable ends of the second movable jaws located between the two limiting rings. Each limiting ring has a maximum outer diameter larger than the outer diameter of the toothed portion of the driving member.

Preferably, each limiting ring has an operative portion on an outer periphery thereof. The operative portion is adapted to be operated by the user to rotate the driving member.

Preferably, the operative end of the body further includes a first open space and a second open space. The first pivotal end of the first movable jaw is received in the first open space. The second pivotal end of the second movable jaw is received in the second open space. A first gap is defined between the first pivotal end of the first movable jaw and a wall face of the first open space. A second gap is defined between the second pivotal end of the second movable jaw and a wall face of the second open space.

Preferably, the fixed jaw includes two first limiting portions spaced from each other along the rotating axis. Two second limiting portions are formed on two sides of the toothed portion of the driving member. Each second limiting portion rotatably abuts one of the first limiting portions.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
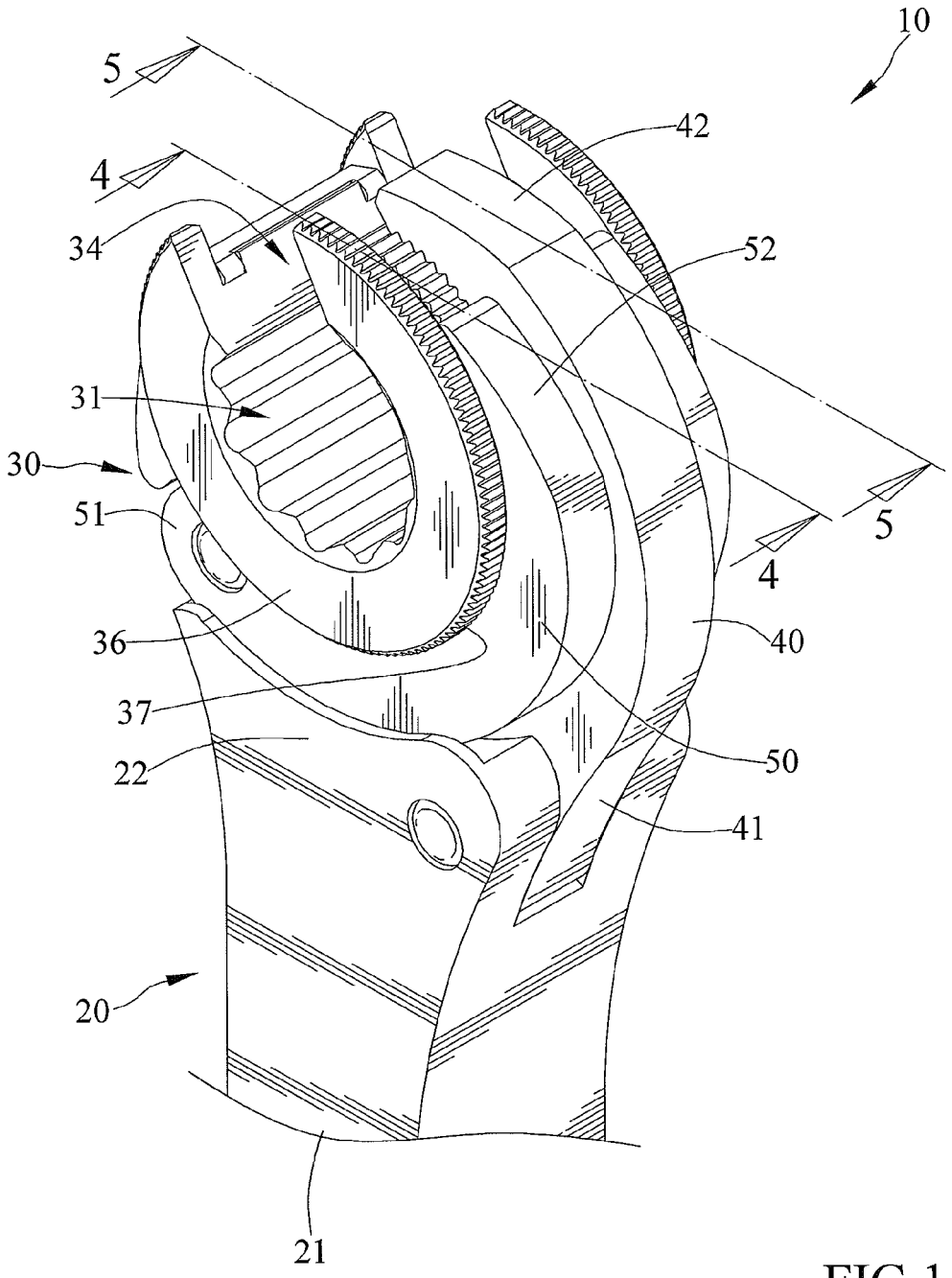
FIG. 1 shows a perspective view of a ratchet wrench according to the present invention.
Figure 2:
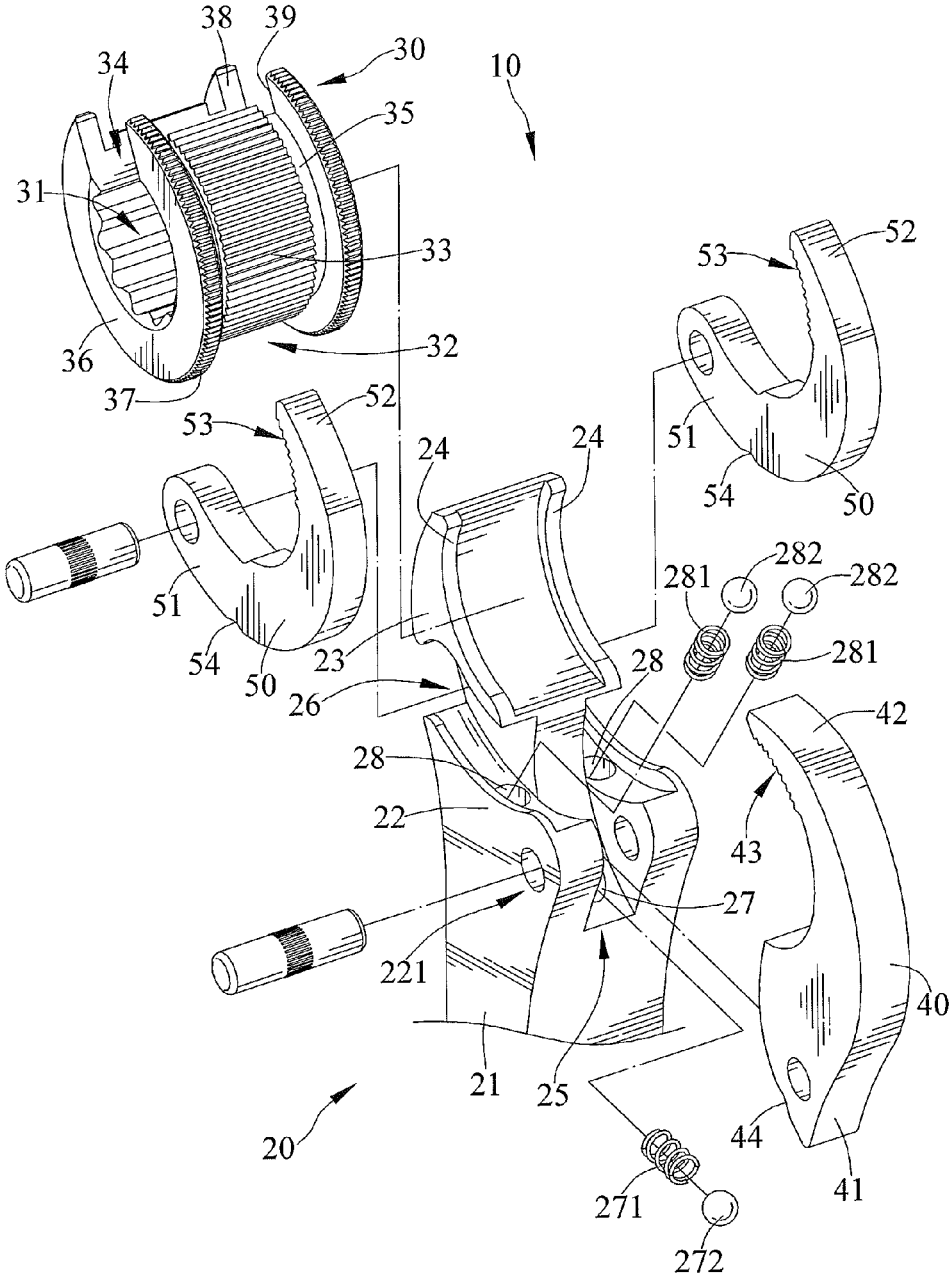
FIG. 2 shows an exploded, perspective view of the ratchet wrench of FIG. 1.
Figure 3:
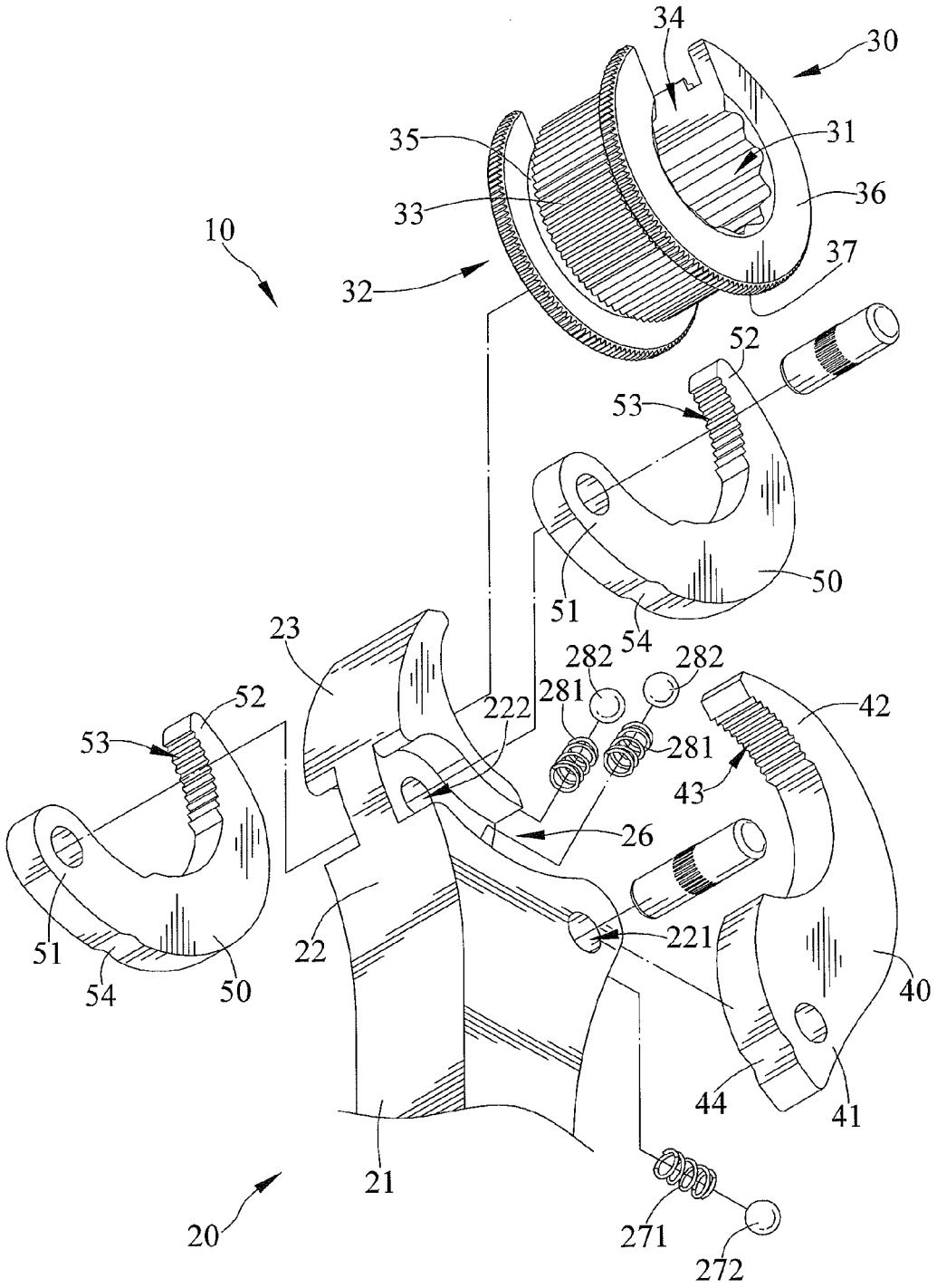
FIG. 3 shows another exploded, perspective view of the ratchet wrench of FIG. 1.
Figure 4:
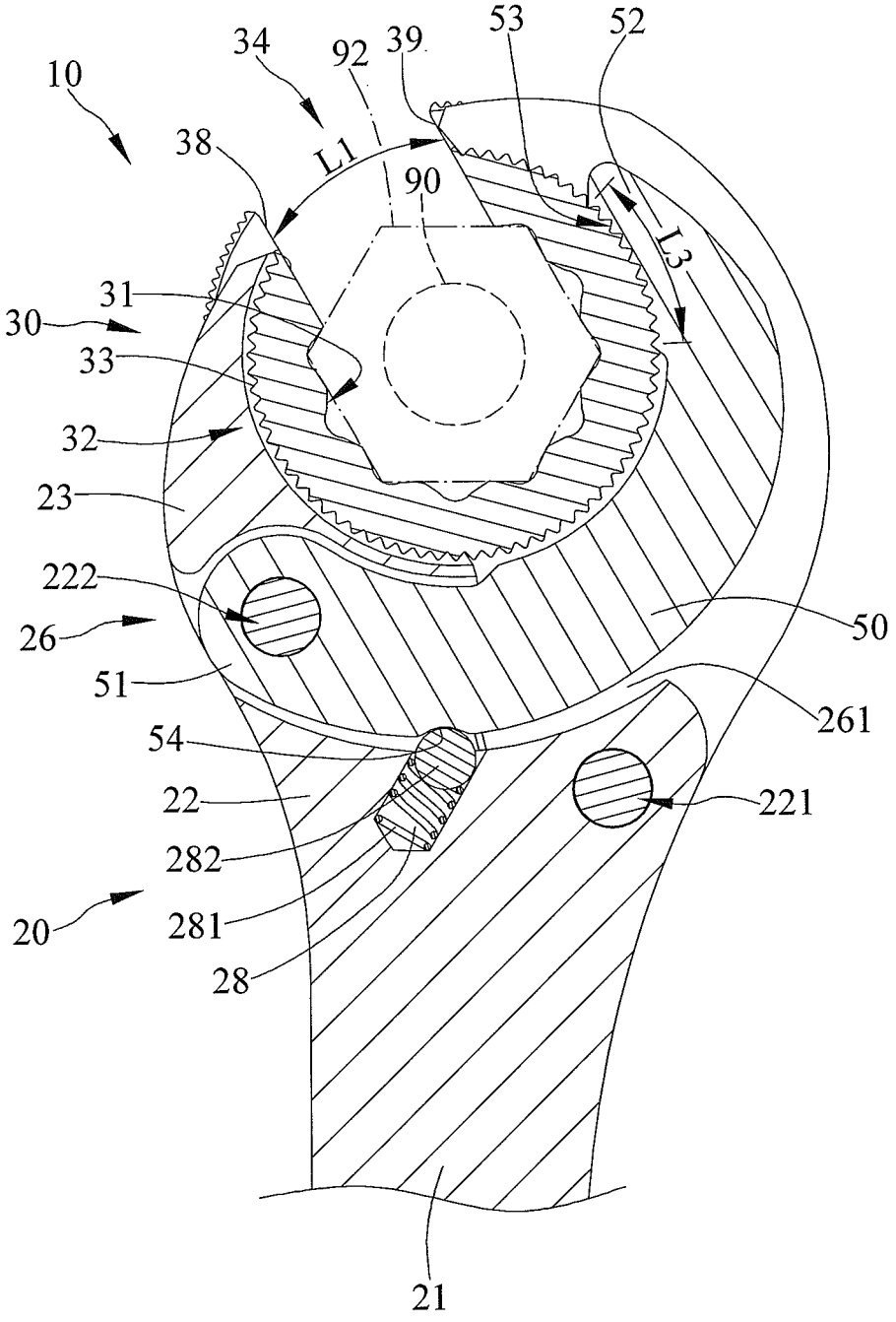
FIG. 4 shows a cross sectional view taken along section line 4-4 of FIG. 1.
Figure 5:
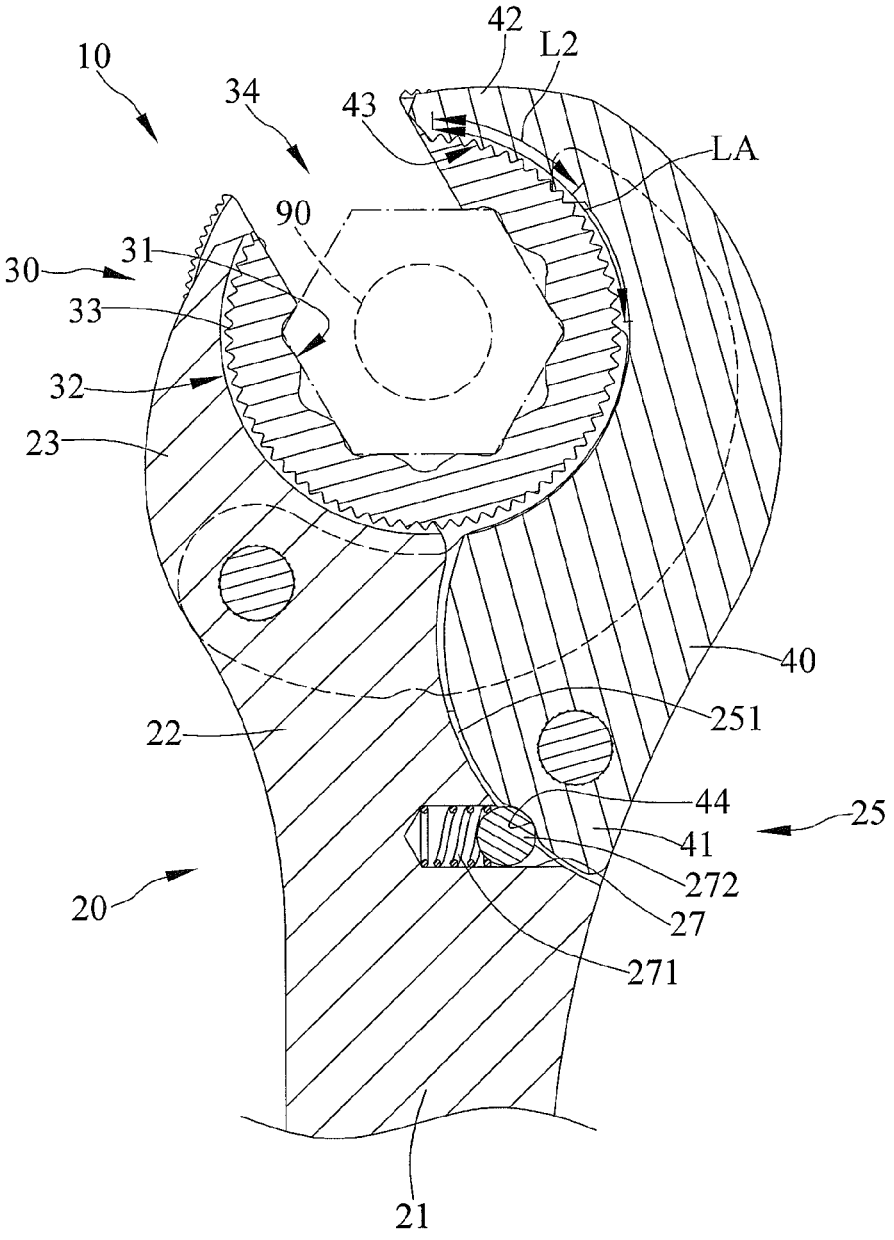
FIG. 5 shows a cross sectional view taken along section line 5-5 of FIG. 1.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "side", "end", "portion", "spacing", "length", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

With reference to FIGS. 1-5, an open-ended ratchet wrench 10 according to the present invention includes a body 20, a driving member 30, a first movable jaw 40, and at least one second movable jaw 50.

The body 20 includes a handle portion 21 and an operative end 22. The handle portion 21 is adapted to be operated by a user to rotate the body 20 about a rotating axis. The operative end 22 includes a fixed jaw 23, a first pivotal portion 221, and a second pivotal portion 222 located between the fixed jaw 23 and the first pivotal portion 221. The fixed jaw 23 includes two first limiting portions 24 spaced from each other along the rotating axis. Each first limiting portion 24 is a ridge in the form shown. The operative end 22 further includes a first open space 25 and a second open space 26. A first receptacle 27 is defined in a wall face of the first open space 25. A first spring 271 and a first engaging member 272 are received in the first receptacle 27. At least one second receptacle 28 is defined in a wall face of the second open space 26. In the form shown, two second receptacles 28 are defined in the wall face of the second open space 26, with each second receptacle 28 receiving a second spring 281 and a second engaging member 282.

The driving member 30 is mounted to the fixed jaw 23 and pivotable relative to the fixed jaw 23 about the rotating axis, with the driving member 30 having a central axis coincident with the rotating axis. The driving member 30 includes an inner periphery 31 and an outer periphery 32 spaced from the inner periphery 31 in a radial direction perpendicular to the central axis. The inner periphery 31 of the driving member 30 is adapted to hold an object 92 to be driven to rotate about the rotating axis. The outer periphery 32 of the driving member 30 includes a toothed portion 33 including a plurality of teeth having a first pitch.

The driving member 30 further includes an opening 34 extending from the inner periphery 31 through the outer periphery 32, forming first and second end faces 38 and 39 extending between the inner and outer peripheries 31 and 32. The opening 34 has a first length L1 between the first and second end faces 38 and 39 in a circumferential direction about the rotating axis. Thus, the driving member 30 is substantially C-shaped in cross section. The opening 34 allows passage of a pipe 90 into a space defined by the inner periphery 31. The inner periphery 31 of the driving member 30 can engage with an object 92, such as a nut, on the pipe 90.

The driving member 30 further includes two limiting rings 36 spaced from each other along the central axis, with the toothed portion 33 located between the limiting rings 36. Each limiting ring 36 has an operative portion 37 on an outer periphery thereof, with the operative portion 37 adapted to be operated by the user to rotate the driving member 30. In the form shown, each operative portion 37 has knurls to increase friction with the fingers of the user. Each limiting ring 36 has a maximum outer diameter larger than an outer diameter of the toothed portion 33 of the driving member 30. Two second limiting portions 35 are formed on two sides of the toothed portion 33 of the driving member 30. In the form shown, each second limiting portion 35 is a groove located between the toothed portion 33 and one of the two limiting rings 36. Each groove has a bottom wall rotatably abutting one of the ridges.

The first movable jaw 40 includes a first pivotal end 41 and a first movable end 42 opposite to the first pivotal end 41. The first pivotal end 41 is pivotably connected to the first pivotal portion 221 of the operative end 22 of the body 20. The first movable jaw 40 is pivotable relative to the body 20 about a first pivot axis parallel to the rotating axis. The first pivotal end 41 of the first movable jaw 40 is received in the first open space 25, with a first gap 251 defined between the first pivotal end 41 of the first movable jaw 40 and the wall face of the first open space 25.

The first movable end 42 includes a side facing the driving member 30 and having a first toothed portion 43. The first movable end 42 is located between the limiting rings 36 and between the second limiting portions 35. The first toothed portion 43 meshes with the toothed portion 33 of the driving member 30. The first toothed portion 43 includes a plurality of teeth having a second pith equal to the first pitch, with the rearmost tooth of first toothed portion 43 located between the foremost tooth of the first toothed portion 43 and the first pivotal end 41. The first toothed portion 43 has a second length L2 between the foremost tooth and the rearmost tooth thereof in the circumferential direction. The second length L2 is smaller than the first length L1.

In the form shown, the at least one second movable jaw 50 includes two second movable jaws 50, with the first movable jaw 40 located between the second movable jaws 50. Each second movable jaw 50 includes a second pivotal end 51 and a second movable end 52 opposite to the second pivotal end 51. The second pivotal end 51 of each second movable jaw 50 is pivotably connected to the second pivotal portion 222 of the operative end 22 of the body 20. The second movable jaw 50 is pivotal relative to the body 20 about a second pivotal axis parallel to the rotating axis. The second pivotable end 51 of each second movable jaw 50 is received in the second open space 26, with a second gap 261 defined between the second pivotal end 51 and the wall face of the second open space 26.

The second movable end 52 of each second movable jaw 50 includes a side facing the driving member 30 and having a second toothed portion 53, with the second toothed portion 53 meshed with the toothed portion 33 of the driving member 30. The second toothed portion 53 of each second movable jaw 50 includes a plurality of teeth having a third pitch equal to the first pitch, with the rearmost tooth of the second toothed portion 53 located between the foremost tooth of the second toothed portion 53 and the second pivotal end 51. The second movable ends 52 of the second movable jaws 50 are located between the limiting rings 36 and between the second limiting portions 35. The second toothed portion 53 of each second movable jaw 50 has a third length L3 between the foremost tooth and the rearmost tooth thereof in the circumferential direction. The third length L3 is smaller than the first length L1 and equal to the second length L2.

Two teeth of the toothed portion 33 of the driving member 30 mesh with the foremost tooth of the second toothed portion 53 of each second movable jaw 50 and a tooth of the second toothed portion 53 of each second movable jaw 50 immediately behind the foremost tooth of the second toothed portion 53. The two teeth of the toothed portion 33 of the driving member 30 also mesh with the rearmost tooth of the first toothed portion 43 and a tooth of the first toothed portion 43 immediately in front of the rearmost tooth of the first toothed portion 43. This reduces deformation of the toothed portion 33 of the driving member 30 during operation, prolonging the service life of the driving member 30. A spacing LA between the foremost tooth of the first toothed portion 43 and the rearmost tooth of the second toothed portion 53 in the circumferential direction is larger than the first length L1.

Each of the first and second movable jaws 40 and 50 is pivotable between a first position and a second position. The first toothed portion 43 is engaged with the toothed portion 33 of the driving member 30 when the first movable jaw 40 is in the first position. The first toothed portion 43 is disengaged from the toothed portion 33 of the driving member 30 when the first movable jaw 40 is in the second position. The second toothed portion 53 of each second movable jaw 50 is engaged with the toothed portion 33 of the driving member 30 when the second movable jaw 50 is in the first position. The second toothed portion 53 of each second movable jaw 50 is disengaged from the toothed portion 33 of the driving member 30 when the second movable jaw 50 is in the second position. The movement paths of the first and second movable jaws 40 and 50 between the first and second positions are similar to each other, providing operational convenience to the user. A spacing between the first toothed portion 43 and the fixed jaw 23 is smaller than a spacing between the fixed jaw 23 and each second movable jaw 50. When the first and second movable jaws 40 and 50 are in the second positions, the spacing between the first toothed portion 43 and the fixed jaw 23 is smaller than the outer diameter of the toothed portion 33 of the driving member 30, preventing the driving member 30 from disengaging from between the fixed jaw 23 and the first movable jaw 40 through movement in the radial direction.

The first engaging member 272 biases the first movable jaw 40 towards the first position of the first movable jaw 40 under action of the first spring 271. Each second engaging member 282 biases one of the second movable jaws 50 towards the first position of the second movable jaw 50 under action of the second spring 281. In the form shown, the first movable jaw 40 includes a first engagement portion 44 facing the first receptacle 27, with the first engaging member 272 pressing against the first engagement portion 44 to bias the first movable jaw 40 towards the first position of the first movable jaw 40 while forming the second gap 251. Each second movable jaw 50 includes a second engagement portion 54 facing one of the second receptacles 28, with the second engaging member 282 pressing against the second engagement portion 54 to bias the second movable jaw 50 towards the first position of the second movable jaw 50 while forming the second gap 261.

Figure 6:
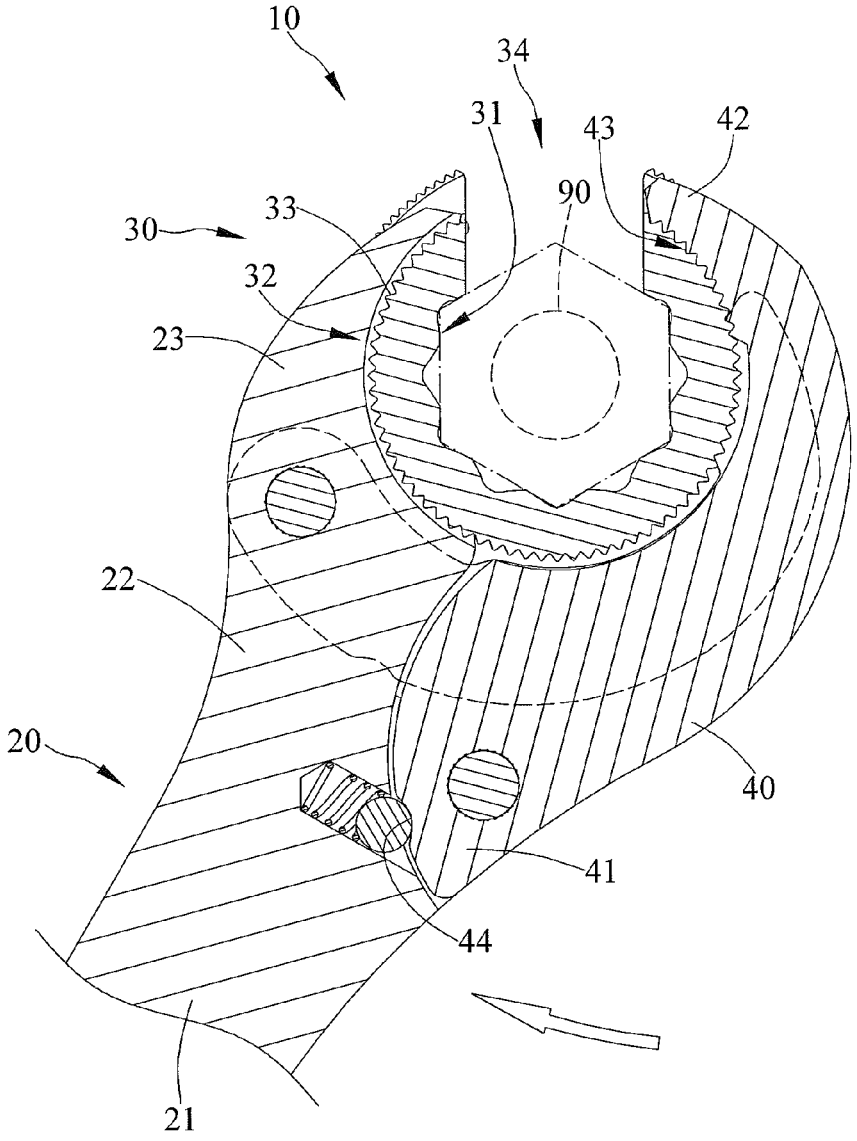
FIG. 6 is a view similar to FIG. 6, with the ratchet wrench rotated in a clockwise direction.
Figure 7:
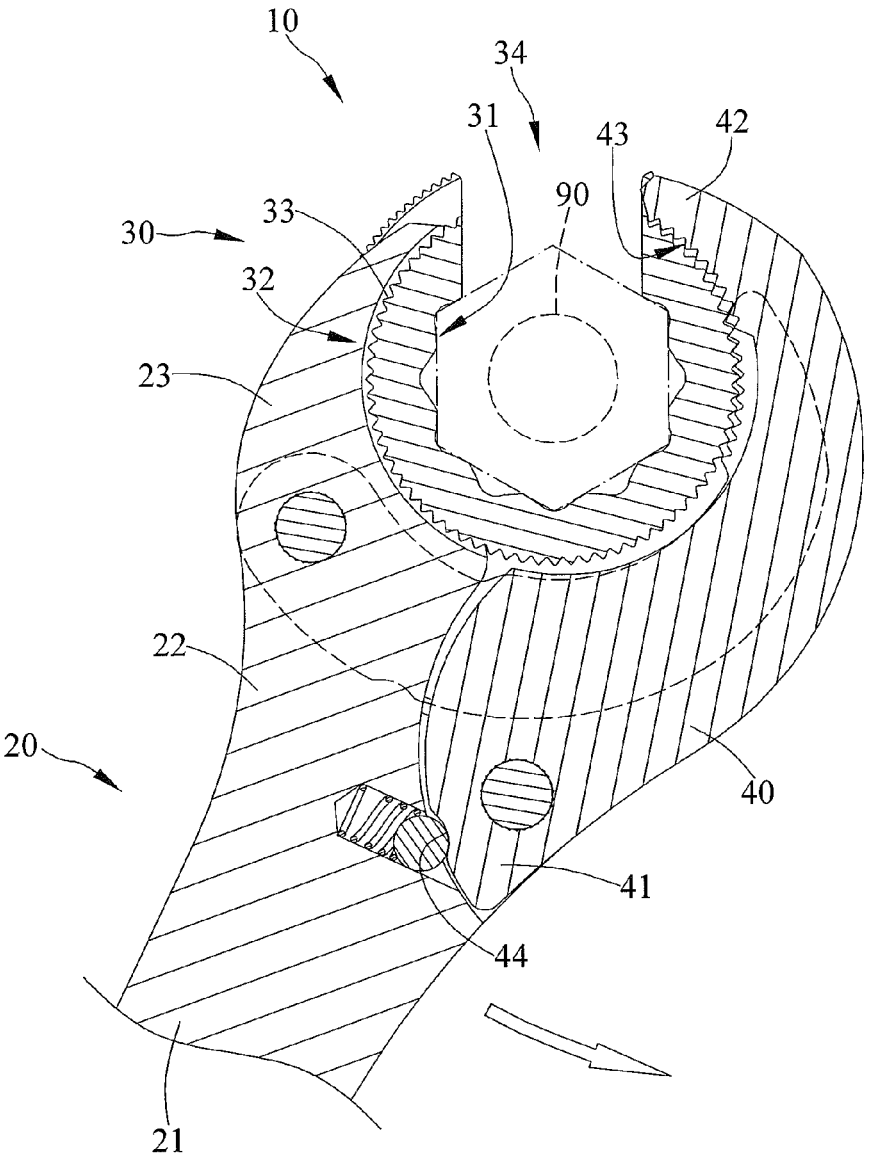
FIG. 7 is a view similar to FIG. 5, with the ratchet wrench rotated in a counterclockwise direction.

In use, when the user rotates the open-ended ratchet wrench 10 in the clockwise direction shown in FIG. 6, the first and second toothed portions 43 and 53 drives the toothed portion 33 of the driving member 30, moving the object 92 in the clockwise direction. When the open-ended ratchet wrench 10 is rotated in the counterclockwise direction shown in FIG. 7, the driving member 30 pushes the first and second movable jaws 40 and 50 towards the second positions, with the first and second toothed portions 43 and 53 sliding relative to the toothed portion 33 of the driving member 30 without driving the driving member 30 and the object 92. When the user stops rotating the open-ended ratchet wrench 10, the first and second engaging members 272 and 282 bias the first and second movable jaws 40 and 50 to the first positions.

Figure 8:
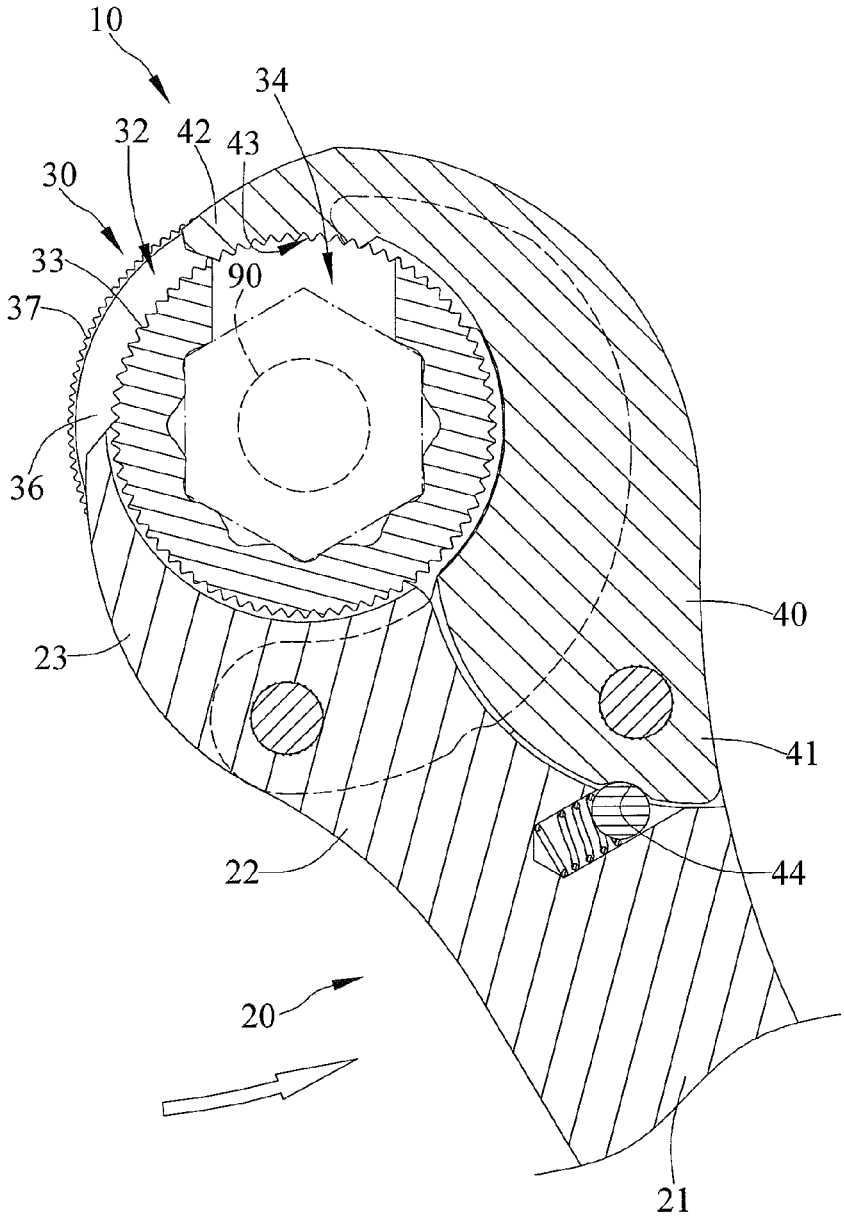
FIG. 8 is a view similar to FIG. 7, with the ratchet wrench further rotated in the clockwise direction.

With reference to FIG. 8, when the open-ended ratchet wrench 10 is further rotated in the counterclockwise direction, the body 20 rotates relative to the driving member 30. The first toothed portion 43 moves towards the opening 34 of the driving member 30. Since the second length L2 is smaller than the first length L1, the first toothed portion 43 is aligned with the opening 34 and disengages from the toothed portion 33 for a period of time while the second toothed portions 53 engage with the toothed portion 33. In this case, the body 20 can still drive the driving member 30.

Figure 9:
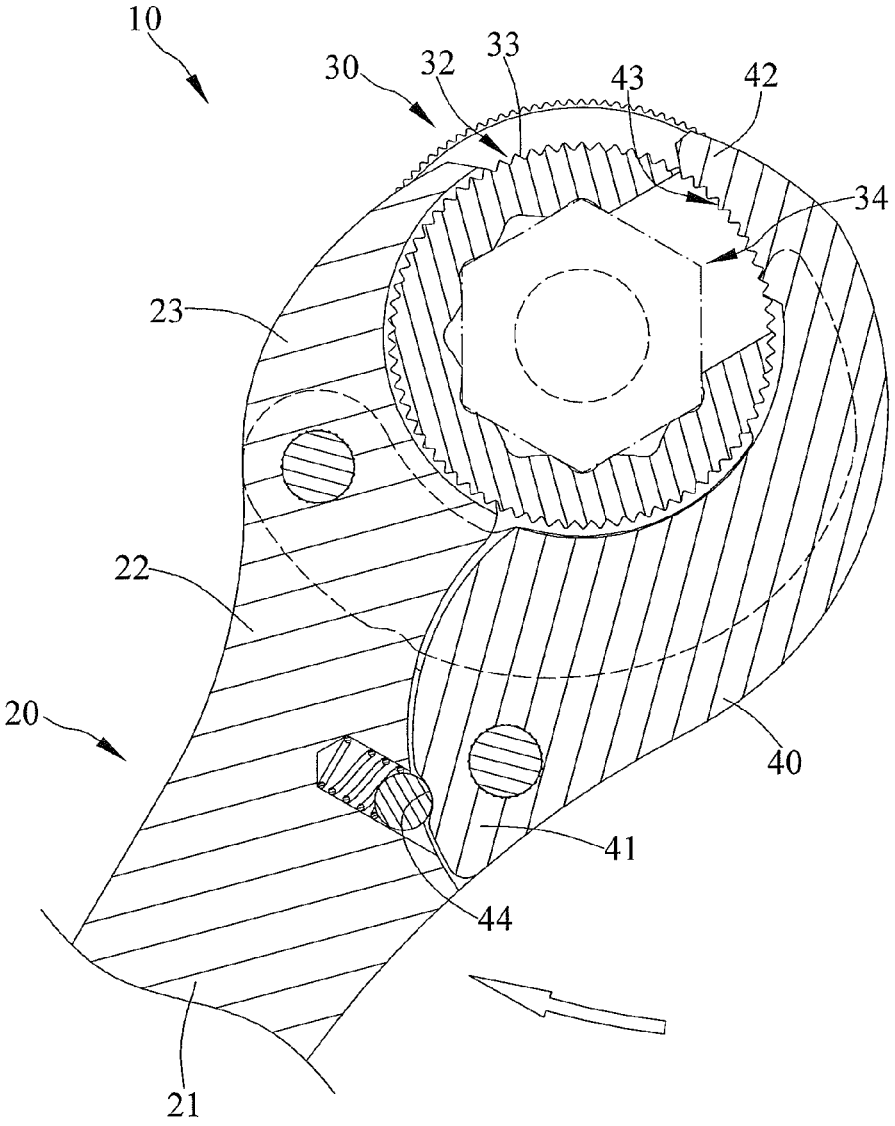
FIG. 9 is a view similar to FIG. 8, with the ratchet wrench rotated in the clockwise direction.
Figure 10:
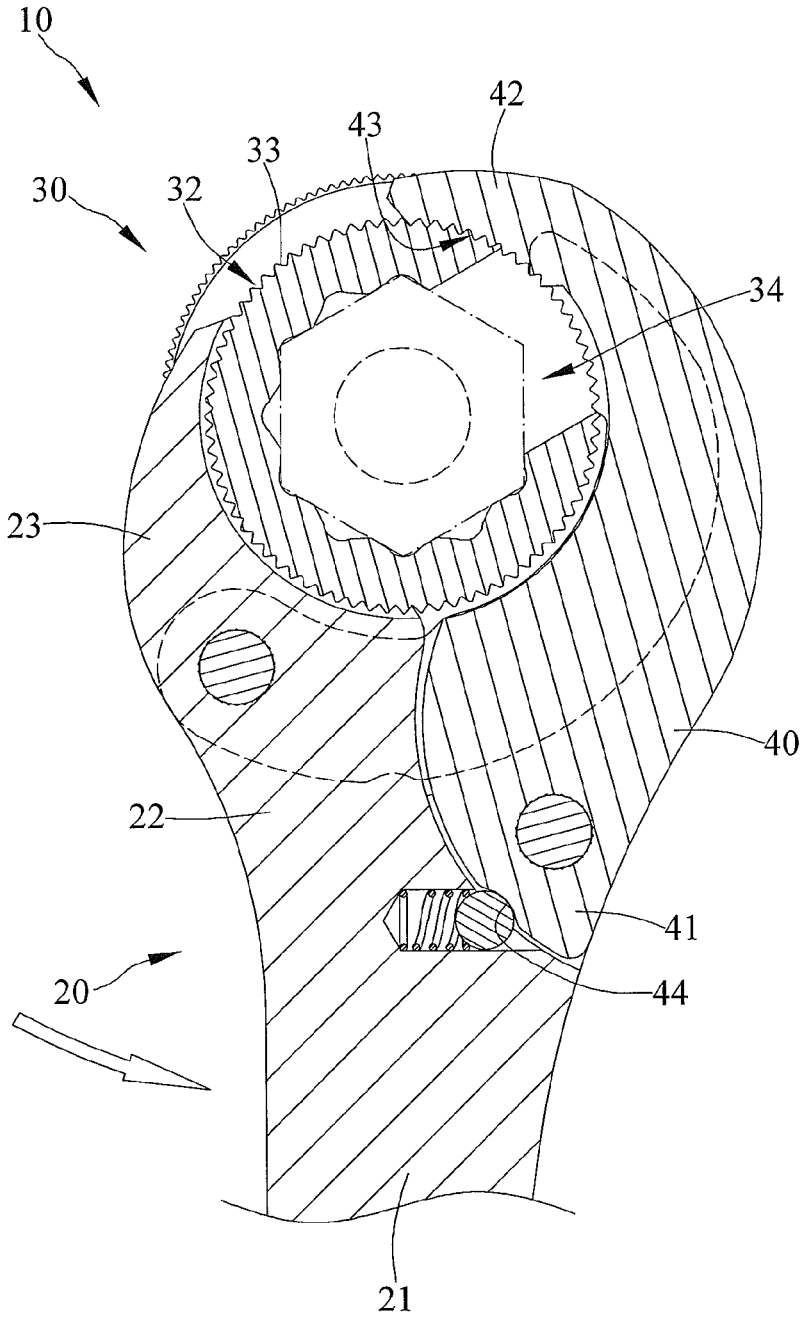
FIG. 10 is a view similar to FIG. 9, with the ratchet wrench rotated in the counterclockwise direction.

After changing the angular position of the body 20 without driving the object 92, the user can move the open-ended ratchet wrench 10 in the clockwise direction to tighten (or loosen) the object 92, as shown in FIG. 9. After rotation through an angle, the open-ended ratchet wrench 10 is rotated in the counterclockwise direction such that the body 20 rotates relative to the driving member 30. The second toothed portions 53 move towards the opening 34 of the driving member 30. Since the third length L3 is smaller than the first length L1, the second toothed portions 53 are aligned with the opening 34 and disengage from the toothed portion 33 for a period of time while the first toothed portion 43 engages with the toothed portion 33. In this case, since the spacing LA is larger than the first length L1, the body 20 the body 20 can still drive the driving member 30 to drive the object 92, as shown in FIG. 10.

Figure 11:
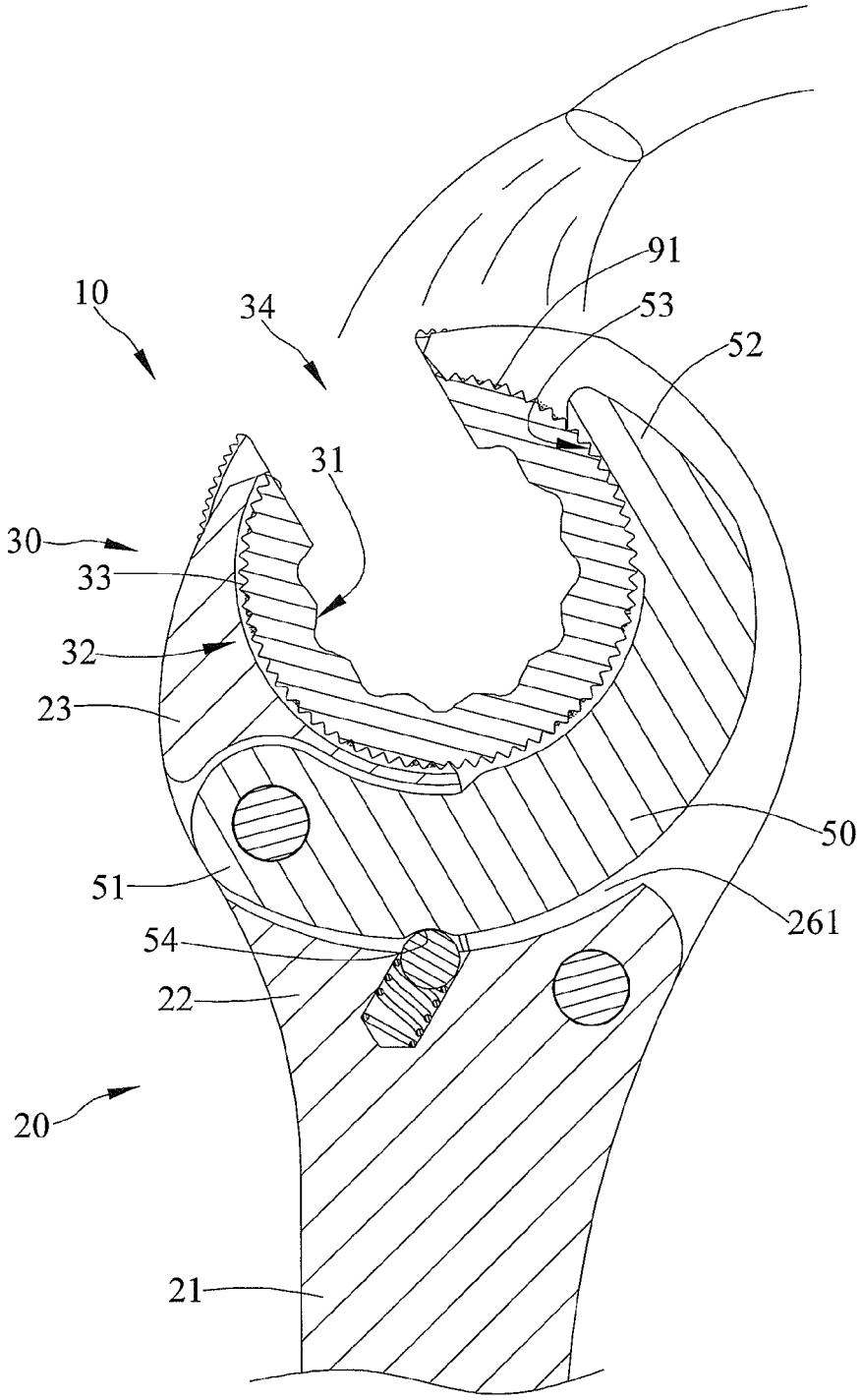
FIG. 11 is a cross sectional view illustrating cleaning of the ratchet wrench.

With reference to FIG. 11, when dirt 91 enters between the fixed jaw 23, the driving member 30, and the first and second movable jaws 40 and 50, the positions of the first and second movable jaws 40 and 50 can be adjusted to disengage the driving member 30 from the fixed jaw 23, the first movable jaw 40, or the second movable jaws 50. Thus, the user can wash the toothed portion 33 and the first and second toothed portions 43 and 53. Alternatively, the user can rotate the driving member 30 and clean the exposed portion of the driving member 30. Since the first and second gaps 251 and 261 provide sufficient space, the dirt 91 entering the first and second gaps 251 and 261 is less likely to get stuck in the first and second gaps 251 and 261 and will fall out of the first and second gaps 251 and 261 after a period of time. Furthermore, the user can use water to rinse the dirt 91 out of the first and second gaps 251 and 261.

The open-ended ratchet wrench 10 according to the present invention has several advantages. Firstly, the open-ended ratchet wrench 10 is durable and will not damage or malfunction in a severe environment after long-term operation. Thus, the user does not have to care about the environment, because the open-ended ratchet wrench 10 will not damage or malfunction due to the dust or dirt in the environment. Even if the dust or dirt enters the open-ended ratchet wrench 10, the fixed jaw 23 and the first and second movable jaws 40 and 50 can be disengaged from the driving member 30 for cleaning purpose by rinsing the open-ended ratchet wrench 10 with clean water, which is convenient to the user. The manufacturers can save the costs for free replacement or maintenance of the open-ended ratchet wrench 10 while protecting the business reputation.

Secondly, the first and second movable jaws 40 and 50 provide a clamping function and a ratcheting function, effectively saving the costs for manufacturing and maintenance. The user does not have to adjust the open-ended ratchet wrench 10. Rotating the open-ended ratchet wrench 10 in the clockwise and counterclockwise directions achieves the function of driving the object 92 and the ratcheting function of adjusting the angular position of the open-ended ratchet wrench 10, reducing difficulties in use.

Thirdly, the open-ended ratchet wrench 10 includes at least two movable jaws 40 and 50 that can driving the driving member 30 at the same time. Furthermore, the first and second toothed portions 43 and 53 completely mesh with the toothed portion 33 of the driving member 30, increasing the torque capacity of the open-ended ratchet wrench 10 and avoiding damage resulting from excessive torque by the user. Furthermore, the first and second movable jaws 40 and 50 can be easily manufactured and assembled, effectively reducing the costs for maintenance.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. An open-ended ratchet wrench comprising:

a body including a handle portion and an operative end, with the handle portion adapted to be operated by a user to rotate the body about a rotating axis, with the operative end including a fixed jaw, a first pivotal portion, and a second pivotal portion;

a driving member mounted to the fixed jaw and rotatable relative to the fixed jaw about the rotating axis, with the driving member having a central axis coincident with the rotating axis, with the driving member including an inner periphery and an outer periphery spaced from the inner periphery in a radial direction perpendicular to the central axis, with the inner periphery of the driving member adapted to hold an object to be driven to rotate about the rotating axis, with the outer periphery of the driving member including a toothed portion;

a first movable jaw including a first pivotal end and a first movable end opposite to the first pivotal end, with the first pivotal end pivotably connected to the first pivotal portion of the operative end of the body, with the first movable end including a side facing the driving member and having a first toothed portion, with the first toothed portion meshed with the toothed portion of the driving member;

a second movable jaw including a second pivotal end and a second movable end opposite to the second pivotal end, with the second pivotal end pivotably connected to the second pivotal portion of the operative end of the body, with the second movable end including a side facing the driving member and having a second toothed portion, with the second toothed portion meshed with the toothed portion of the driving member, with each of the first and second movable jaws pivotable between a first position and a second position, with the first toothed portion engaged with the toothed portion of the driving member when the first movable jaw is in the first position, with the first toothed portion disengaged from the toothed portion of the driving member when the first movable jaw is in the second position, with the second toothed portion engaged with the toothed portion of the driving member when the second movable jaw is in the first position, with the second toothed portion disengaged from the toothed portion of the driving member when the second movable jaw is in the second position.

2. The open-ended ratchet wrench as claimed in claim 1, with the driving member further including an opening extending from the inner periphery through the outer periphery, forming first and second end faces extending between the inner and outer peripheries, with the opening having a first length between the first and second end faces in a circumferential direction about the rotating axis, with each of the first and second toothed portions including a plurality of teeth, with a rearmost tooth of the first toothed portion located between a foremost tooth of the first toothed portion and the first pivotal end, with a rearmost tooth of the second toothed portion located between the a foremost tooth of the second toothed portion and the second pivotal end, with a spacing between the foremost tooth of the first toothed portion and the rearmost tooth of the second toothed portion in the circumferential direction larger than the first length.

3. The open-ended ratchet wrench as claimed in claim 2, with the first toothed portion having a second length between the foremost tooth and the rearmost tooth thereof in the circumferential direction, with the second length smaller than the first length, with the second toothed portion having a third length between the foremost tooth and the rearmost tooth thereof in the circumferential direction, with the third length smaller than the first length.

4. The open-ended ratchet wrench as claimed in claim 3, with the second pivotal portion located between the fixed jaw and the first pivotal portion, with the first movable jaw pivotable relative to the body about a first pivot axis parallel to the rotating axis, with the second movable jaw pivotable relative to the body about a second pivotal axis parallel to the rotating axis, with the third length equal to the second length.

5. The open-ended ratchet wrench as claimed in claim 2, with the toothed portion of the driving member having a first pitch, with the first toothed portion having a second pitch equal to the first pitch, with the second toothed portion having a third pitch equal to the first pitch.

6. The open-ended ratchet wrench as claimed in claim 1, with two teeth of the toothed portion of the driving member meshed with the foremost tooth of the second toothed portion and a tooth of the second toothed portion immediately behind the foremost tooth of the second toothed portion, with the two teeth of the toothed portion of the driving member also meshed with the rearmost tooth of the first toothed portion and a tooth of the first toothed portion immediately in front of the rearmost tooth of the first toothed portion.

7. The open-ended ratchet wrench as claimed in claim 1, further comprising: another second movable jaw including a pivotal end and a movable end opposite to the pivotal end of the other second movable jaw, with the pivotal end of the other second movable jaw pivotably connected to the second pivotal portion of the operative end of the body, with the movable end of the other second movable jaw including a side facing the driving member and having a toothed portion, with the toothed portion of the other second movable jaw meshed with the toothed portion of the driving member, with the first movable jaw located between the second movable jaw and the other second movable jaw, with a spacing between the first toothed portion and the fixed jaw smaller than a spacing between the fixed jaw and the second movable jaw, with the spacing between the first toothed portion and the fixed jaw smaller than a spacing between the fixed jaw and the other second movable jaw, with the other second movable jaw movable between an engaged position and a disengaged second position, with the toothed portion of the other second movable jaw engaged with the toothed portion of the driving member when the other second movable jaw is in the engaged position, with the toothed portion of the other second movable jaw disengaged from the toothed portion of the driving member when the other second movable jaw is in the disengaged position.

8. The open-ended ratchet wrench as claimed in claim 7, with the spacing between the first toothed portion and the fixed jaw smaller than an outer diameter of the toothed portion of the driving member, with the driving member further including two limiting rings spaced from each other along the central axis, with the first movable end of the first movable jaw, the second movable end of the second movable jaw, and the movable end of the other second movable jaw located between the two limiting rings, with each of the two limiting rings having a maximum outer diameter larger than the outer diameter of the toothed portion of the driving member.

9. The open-ended ratchet wrench as claimed in claim 8, with each of the two limiting rings having an operative portion on an outer periphery thereof, with the operative portion adapted to be operated by the user to rotate the driving member.

10. The open-ended ratchet wrench as claimed in claim 1, with the operative end of the body further including a first open space and a second open space, with the first pivotal end of the first movable jaw received in the first open space, with the second pivotal end of the second movable jaw received in the second open space, with a first gap defined between the first pivotal end of the first movable jaw and a wall face of the first open space, with a second gap defined between the second pivotal end of the second movable jaw and a wall face of the second open space.

11. The open-ended ratchet wrench as claimed in claim 10, with the wall face of the first open space including a first receptacle, with a first spring and a first engaging member received in the first receptacle, with the first engaging member biasing the first movable jaw towards the first position of the first movable jaw under action of the first spring, with the wall face of the second open space including a second receptacle, with a second spring and a second engaging member received in the second receptacle, with the second engaging member biasing the second movable jaw towards the first position of the second movable jaw under action of the second spring.

12. The open-ended ratchet wrench as claimed in claim 11, with the first movable jaw including a first engagement portion facing the first receptacle, with the first engaging member pressing against the first engagement portion to bias the first movable jaw towards the first position of the first movable jaw, with the second movable jaw including a second engagement portion facing the second receptacle, with the second engaging member pressing against the second engagement portion to bias the second movable jaw towards the first position of the second movable jaw.

13. The open-ended ratchet wrench as claimed in claim 10, with the fixed jaw including two first limiting portions spaced from each other along the rotating axis, with two second limiting portions formed on two sides of the toothed portion of the driving member, with each of the two second limiting portions rotatably abutting one of the two first limiting portions.

14. The open-ended ratchet wrench as claimed in claim 13, with the driving member further including two limiting rings spaced from each other along the central axis, with the toothed portion of the driving member located between the two limiting rings, with each of the two limiting rings having a maximum outer diameter larger than the outer diameter of the toothed portion of the driving member, with each of the two second limiting portions being a groove located between the toothed portion of the driving member and one of the two limiting rings, with each of the two first limiting portions being a ridge, with each of the grooves having a bottom wall rotatably abutting one of the ridges.

15. The open-ended ratchet wrench as claimed in claim 1, with the fixed jaw including two first limiting portions spaced from each other along the rotating axis, with two second limiting portions formed on two sides of the toothed portion of the driving member, with each of the two second limiting portions rotatably abutting one of the two first limiting portions.

* * * * *